US005341708A

United States Patent [19]

Nick

[11] Patent Number: 5,341,708

[45] Date of Patent: Aug. 30, 1994

[54] FASTENER SUPPORT APPARATUS

[76] Inventor: Edward V. Nick, 512 Lexington Ave., Fox River Grove, Ill. 60021

[21] Appl. No.: 89,692

[22] Filed: Jul. 9, 1993

[51] Int. Cl.[5] ..... B25B 23/10

[52] U.S. Cl. ..... 81/451; 81/429

[58] Field of Search ..... 81/451–453, 81/ 429; 279/75, 22, 30

[56] References Cited

U.S. PATENT DOCUMENTS

| | | | |
|---|---|---|---|
| 2,310,287 | 2/1943 | Hausbeck . | |
| 2,633,169 | 3/1953 | Siems . | |
| 2,774,401 | 12/1956 | Hallam . | |
| 2,840,126 | 6/1958 | Schmitt | 81/451 X |
| 2,845,968 | 8/1958 | Luber | 81/451 X |
| 2,884,971 | 5/1959 | Dierker . | |
| 3,757,407 | 9/1973 | Bomar | 29/212 |
| 4,058,884 | 11/1977 | Lydon et al. | 29/526 |
| 4,140,161 | 2/1979 | Russo et al. | 81/451 |
| 4,237,946 | 12/1980 | Leitner | 81/451 X |
| 4,653,358 | 3/1987 | Lankry | 81/474 |
| 4,936,169 | 6/1990 | Parsons | 81/57.37 |
| 5,207,127 | 5/1993 | Nick | 81/54 |

*Primary Examiner*—D. S. Meislin

*Attorney, Agent, or Firm*—Godfrey & Kahn

[57] ABSTRACT

A fastener support apparatus for facilitating the installation of individual screws into a work surface which includes a rotatable bit for engaging the head of the screw; a housing borne by the rotatable bit and defining a passageway, and wherein the bit is received in the passageway and the housing simultaneously rotates with the bit; a screw support assembly movably borne by the housing, the screw support assembly including a passageway defining a screw receiving station and which is operable to receive the head of the screw; a locking assembly movably borne by the screw support assembly and operable to travel from a first, partially occluding position relative to the screw receiving station to a second, substantially nonoccluding position; and an actuating assembly movably borne by the screw support assembly and which positions the locking assembly in the first or second positions.

20 Claims, 4 Drawing Sheets

FASTENER SUPPORT APPARATUS

BACKGROUND OF THE INVENTION

1. Field of the Invention

The present invention relates generally to an apparatus for facilitating the installation of individual fasteners, such as screws or the like, and more particularly, to an apparatus which is operable to releasably secure the head of an individual screw in a predetermined location relative to a rotatable bit thereby facilitating the installation of the screw into a work piece, and which further is operable to release the head of the screw from the predetermined location upon the engagement of the apparatus with the work piece.

2. Description of the Prior Art

During the construction of buildings, and in the manufacture of various articles of commerce, it is typically necessary for a worker to install numerous screws or other types of threaded fasteners into assorted work pieces by employing powered screw driving tools having various configurations and designs. In the construction of dwellings, for example, work pieces which may be joined to other objects or surfaces by threaded fasteners may include sheet-like materials such as drywall, decorative paneling, plywood subflooring and the like. These materials, of course, have different textures and also may be positioned in assorted locations and positions which may from time to time present problems with regards to installing a screw type fastener in the respective surfaces. For example, the tough texture of sheet-like materials, such as exterior-grade plywood may present difficulties in starting the threaded fastener or further, the screw may need to be driven in a nonperpendicular or angled relationship through the work piece. Moreover, and during the installation of screws or other fasteners which have a substantial length dimension, the slotted portion of the screw head will often become distorted or burred by the rotatable bit of the powered screw driver when the bit temporarily disengages from the screw head. When this event occurs, installation or removal of the screw often becomes difficult. Moreover, the aesthetic appearance of the object may be adversely affected. To prevent or otherwise inhibit this distortion or burring of a screw head, or further, to insure that the screw is being started in an appropriate fashion in the work piece, which is not provided with a pilot hole, it is often necessary to apply substantial physical force to the powered screwdriver thereby fixedly positioning the screw in tight engagement with the rotatable bit. Further, and if the screw is being installed in material which is rather tough, such as in pressure treated lumber, this physical force will need to be maintained until the screw is installed completely into the material.

Heretofore, various devices and assemblies have been constructed and incorporated into both manual and powered screw driving tools and which hold individual screws during the screw installation process. These prior art screw holding devices have generally included two categories of mechanical design. In the first design category, these prior art screw holding devices have included a powered screw driving means and a detachably mounted device for holding a plurality of screws in a ready, screw driving position. In the second design category, these prior art screw holding devices have typically included a manually operated screw driving means and which has made integral therewith, an attachment for holding individual screws.

Examples of prior art devices which may include the aforementioned screw holding devices are found in U.S. Pat. Nos. 5,207,127; 3,757,407; 4,936,169; 2,884,971; 2,774,401, 2,310,287; and 2,633,169.

Foremost among the noted deficiencies of some of these prior art screw holding devices is their apparent inability to securely hold a screw, during the installation thereof or to automatically release the screw when the screw holding device engages a work surface. More particularly, the prior art screw holding devices of the first design category automatically release an individual screw from the device prior to the complete installation of the screw. Further, the screw holding devices of the second design category typically required that a user manually disengage the individual screw from the device, such as by actuating a lever or the like. As should be understood, the prior art screw holding devices of the first design category do not hold the heads of the respective individual screws in a locked position against the rotatable bit throughout the entire screw installation cycle. Therefore, the individual screw heads may become distorted or burred during installation, unless, the user applies substantial force to the device to insure a tight, interlocking relationship between the bit and the screw head. Of course, utilizing a tool under these conditions for a prolonged period of time will eventually result in worker fatigue.

Another deficiency of the prior art screw holding devices of the second design category, as noted earlier, is that the user must manually disengage or release the screw from the device. For example, in U.S. Pat. No. 2,774,401, a screw driver is disclosed which includes a screw holding device and a screw head pressure applicator. The device is operable, by way of a pivoted lever, to cause the bit to tightly engage the screw head. In operation, a user must manually move the lever back and forth from a first, screw release position, wherein the screw head pressure applicator is disposed in a nonengaging position, which permits a screw to be loaded in the screw holding device, and a second, screw engaging position wherein the bit tightly engages the screw. This type of a device, of course, increases the total number of steps required to install a single screw, and which, when multiplied by hundreds of screws, reduces the efficiency of any manufacturing process employing same. Other prior art screw holding devices of the second design type generally require that assorted steps be taken by a user to disengage or release a screw from the device which similarly results in reduced efficiency during the manufacturing process.

Still another deficiency common to a few of the prior art screw holding devices of the first design category is the propensity for such assemblies to be heavy and cumbersome when employed in typical commercial, or consumer environments. An example of such a device is disclosed in U.S. Pat. No. 4,936,169. As should be understood, an operator of such a prior art screw holding device would typically utilize this device continually throughout a work shift, or during the course of a common home improvement project. Further, and as a general matter, power fastening tools of this same type are typically utilized during such operations at arm's length away from a user's body, or in some cases, directly above the user's head. Therefore, the weight and cumbersome characteristics of these prior art fastening tools reduces the efficiency of a user by causing fatigue.

Yet another deficiency attendant with the prior art screw holding devices of the first design category is their complexity of design. This is particularly true for the prior art screw holding device which is disclosed in U.S. Pat. No. 4,936,169. This complexity of design, as should be understood, increases the likelihood that such screw holding devices will fail, jam or otherwise malfunction during operation when they are exposed to the dust or debris which is typically generated during their use. Further, and as should be readily apparent, the complex design of these screw holding devices increases the manufacturing costs for same.

Therefore, it has long been known that it would be desirable to have an apparatus for facilitating the installation of screws, and which is particularly well suited to retain a screw in tight engagement with respect to a bit of a screw driving means, and which further is operable to automatically release the screw upon engagement of the apparatus with a work piece or surface, and wherein the apparatus is lightweight, simple in design, and may also be releasably mounted on a variety of portable powered screw driver tools, or similar devices without substantial modification of the tool or device.

OBJECTS AND SUMMARY OF THE INVENTION

Therefore, it is an object of the present invention to provide an improved fastener support apparatus.

Another object of the present invention is to provide such an apparatus which is operable to obtain the individual benefits to be derived from related prior art apparatuses and practices while avoiding the detriments individually associated therewith.

Another object of the present invention is to provide such an apparatus which is operable to facilitate the installation of fasteners into a work piece.

Another object of the present invention is to provide such an apparatus which is lightweight, and maneuverable, and therefore reduces fatigue during the use thereof.

Another object of the present invention is to provide such an apparatus which can be mounted on the rotatable bit of a drill or the like without requiring any substantial modification or alteration of the housing of the accompanying drill.

Another object of the present invention is to provide such an apparatus which is operable to fixedly position a screw in tight engagement with a bit of a powered screw driving means throughout a substantial portion of the screw installation cycle, but which automatically releases the screw when the apparatus contacts or otherwise engages a work piece or surface.

Another object of the present invention is to provide such an apparatus which reduces, or substantially eliminates, distortion or burring of a screw head.

Another object of the present invention is to provide such an apparatus which is of a relatively nominal cost to purchase and maintain, and which further is inexpensive to operate.

Another object of the present invention is to provide such an apparatus which is characterized by ease of employment, and simplicity of construction.

Further objects and advantages of the present invention are to provide improved elements and arrangements thereof in an apparatus for the purposes described which is dependable, economical, durable and fully effective in accomplishing its intended purposes.

These and other objects and advantages are achieved in an apparatus for facilitating the installation of individual screws into a work surface and which includes, a rotatable bit for engaging the head of the screw; a housing borne by the rotatable bit and defining a passageway, and wherein the bit is received in the passageway, and the housing rotates simultaneously with the bit; a screw support assembly movably borne by the housing and defining a screw receiving station which is operable to receive the head of the screw; a locking assembly borne by the screw support assembly and operable for travel from a first, partially occluding position relative to the screw receiving station, to a second, substantially nonoccluding position; and an actuating assembly borne by the screw support assembly and which positions the locking assembly in the first or second positions, and wherein the actuating assembly is freely rotatable relative to the screw support assembly, and wherein during operation, the locking assembly when disposed in the first, partially occluding position retains the head of the screw in the screw receiving station, and when disposed in the second substantially nonoccluding position releases the screw from the screw receiving station such that the screw may be driven into the work surface.

DETAILED DESCRIPTION

FIRST FORM

Figure 1:
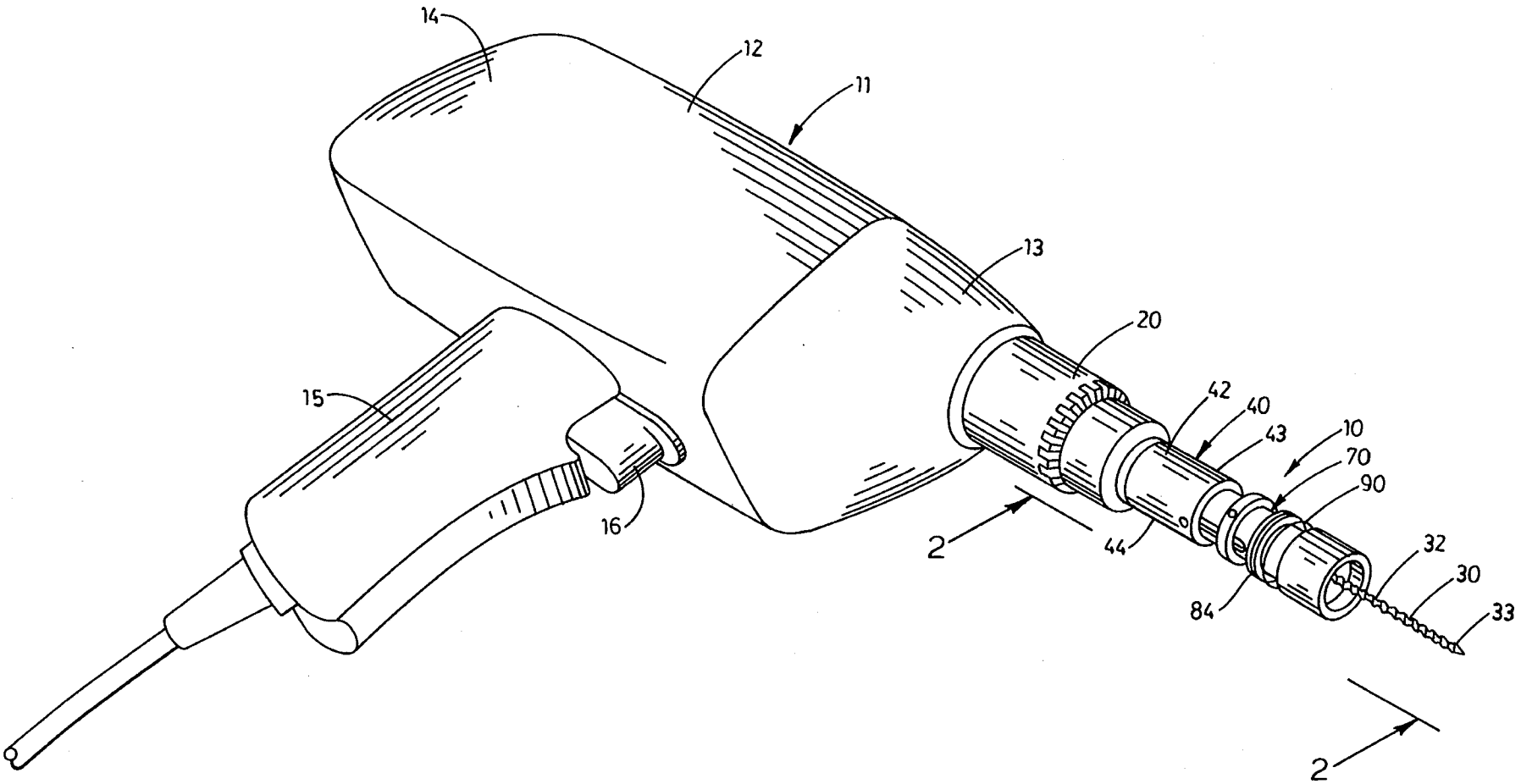
FIG. 1 is a right, perspective, environmental view of the first form of the apparatus of the subject invention, and which is shown in a typical operative configuration.
Figure 6:
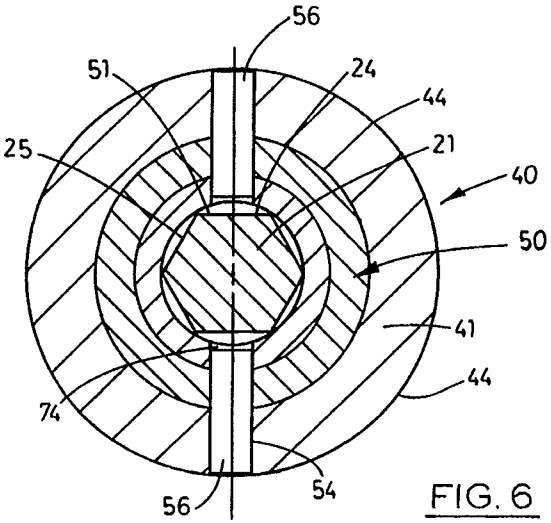
FIG. 6 is a somewhat enlarged, transverse, vertical sectional view of the apparatus of the subject invention, and which is taken from a position along line 6—6 of FIG. 2.

The apparatus of the present invention is generally indicated by the numeral 10 and is best seen in the environmental view of FIG. 1. The first form of the apparatus 10 is rendered operable for use in combination with a portable power drill and which is generally indicated by the numeral 11. As should be understood, the drill is of conventional design and may be energized by assorted conventional power sources. The drill has a housing which is generally indicated by the numeral 12, and which has a forward end 13, and an opposite rearward end 14. Depending downwardly relative to the rear end of the housing 14 is a handle 15. The handle mounts a movable trigger or switch 16 which selectively energizes the drill thereby imparting motion to a rotatable chuck 20 by means of a motor which is not shown. The chuck 20 is also of conventional design and is operable to receive, and fixedly mount for substantially rotatable motion, a bit 21, which is also of conventional design. The rotatable bit has a first end 22 which is designed to engage a head of a suitable screw, and which will be discussed in further detail hereinafter. Further, the bit has an opposite, second end 23 and which is received in, and otherwise engaged by the chuck. As best seen by reference to FIG. 3, the second end of the rotatable bit has an exterior surface 24 which defines a plurality of engagement surfaces 25. The second end of the bit has a substantially hexagonal, cross-sectional configuration. This is best seen by reference to FIG. 6.

Figure 2:
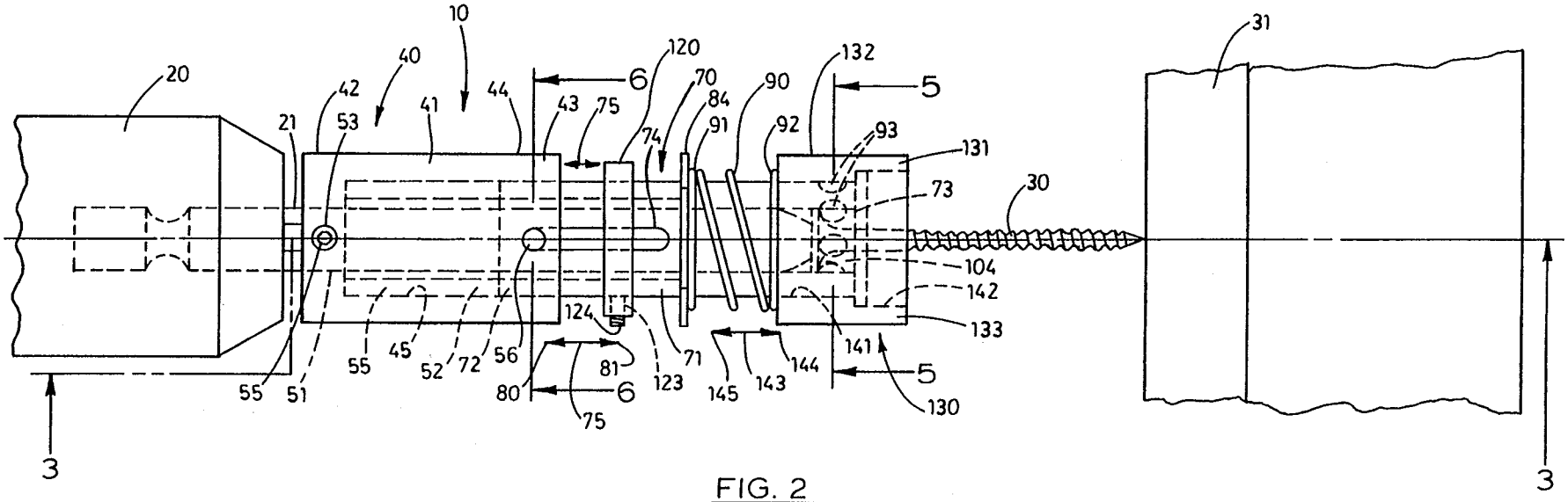
FIG. 2 is a fragmentary, side elevation view of the apparatus of the subject invention, and which is taken from a position along line 2—2 of FIG. 1.
Figure 3:
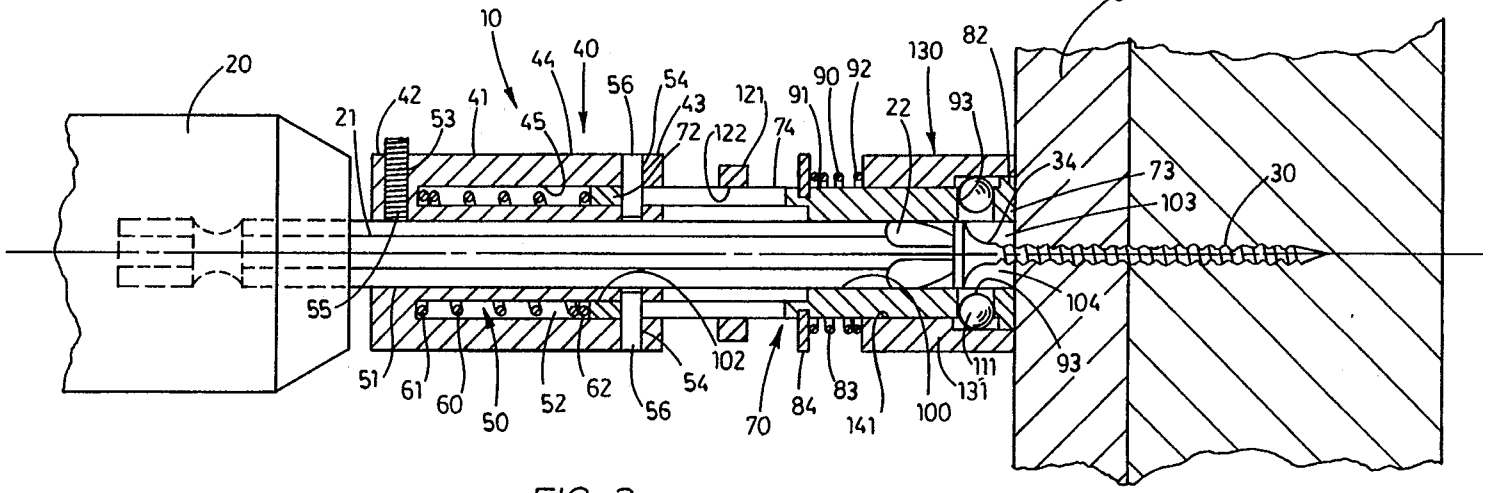
FIG. 3 is a fragmentary longitudinal vertical sectional view of the apparatus of the subject invention, and which is taken from a position along line 3—3 of FIG. 2.
Figure 4:
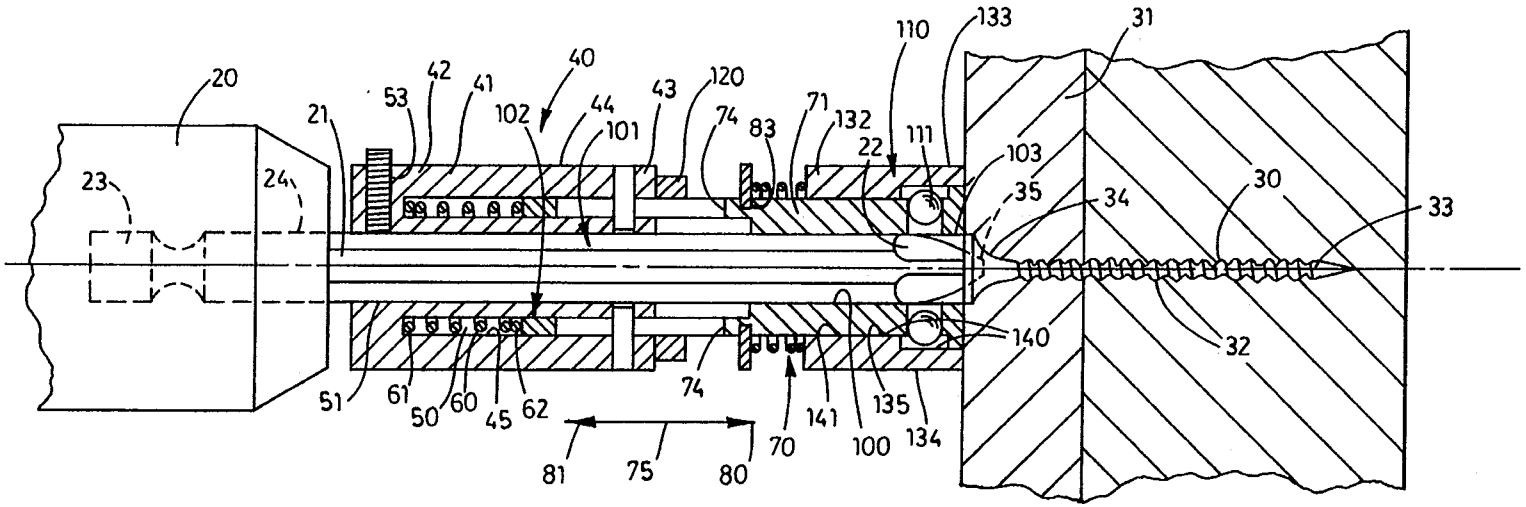
FIG. 4 is a fragmentary, longitudinal, vertical sectional view of the apparatus of the subject invention, and which is taken from a position along line 3—3 of the FIG. 2.

As best understood by a study of FIGS. 3 and 4, respectively, the apparatus 10 of the subject invention is operable for facilitating the installation of individual screws 30 into a work surface or piece and which is generally indicated by the numeral 31. The screws 30 are of conventional design and have a main body 32 which includes a threaded shaft 33 and which is adapted to threadably engage the work surface 31. Further, the screw has an opposite, screw head 34 which has formed in its surface a slot 35 for receiving the first end 22 of the rotatable bit 21. As best seen by reference to FIG. 1, the apparatus 10 of the subject invention is mounted on the rotatable bit. More specifically, and as shown most clearly by reference to FIG. 2, the apparatus 10 of the subject invention is mounted, by means of a housing 40 on the bit 21. As shown in FIG. 2, the housing 40, has a main body 41, which is generally uniformly cylindrical, and which further has a first, or proximal end 42, and an opposite, second or distal end 43. Additionally, the main body 41 has an exterior facing surface 44 and an opposite, interior facing surface 45 which defines a cavity which is generally indicated by the numeral 50. As most clearly seen by reference to FIG. 3, the cavity includes a first bore 51 which has a predetermined diametral dimension which is just slightly greater than the outside diametral dimension of the drill bit 21; and further has a second bore 52, which is substantially coaxially aligned therewith, and which has a predetermined diametral dimension which is greater in relative comparison than the first bore. A threaded bore 53 is formed in the main body and is disposed in radially extending relation relative to the first bore 51. Additionally, a pair of substantially coaxial aligned passageways or bores 54 are formed in the main body and communicate with the second bore. As best seen in FIG. 3, a threaded fastener 55, such as an Allen screw, is received in the threaded bore 53 and is operable to be threadably advanced into contact with the drill bit 21 thereby securing the house in a fixed location on the drill bit 21 and further rendering it rotatable therewith. Further, a pair of pins, or posts 56, are individually received, in the nature of a friction fit, in each of the coaxial aligned passageways 54. As best seen in FIG. 3, the pair of pins 56 extend into the cavity 50 and are operable to interact with a screw support assembly which will be discussed in greater detail hereinafter.

As best seen in FIGS. 3 and 4, a first biasing assembly, and which is illustrated herein as a first spring 60, is telescopingly received in the cavity 50, and more specifically, the second bore 52. The spring is of conventional design, and is operable to bias or urge the screw support assembly, which will be disclosed below, along a predetermined path of travel. The first spring has a proximal end 61, which rests on the main body 41 of the housing 40, and a distal, or second end 62 which acts upon the screw support assembly 70. As best seen in FIG. 3, the screw support assembly 70 includes a main body 71, which has a first end 72, which is telescopingly received in the cavity 50, and a distal or second end 73 which is remote thereto. The screw support assembly and more specifically, the main body thereof, is generally uniformly cylindrical. As best seen in FIGS. 2 and 3, a pair of substantially coaxial aligned, and longitudinally extending channels 74 are formed in the main body 71 and are operable to be engaged by, or cooperate with, the pair of pins 56. As should be understood, the pair of pins, acting in combination with the pair of channels, causes the main body 71 to be simultaneously rotatable with the housing 40, and further renders it reciprocally moveable along a substantially linear path of travel 75 between a first, or extended position 80, to a second or retracted position 81. The significance of this feature will be discussed in further detail hereinafter. As best seen by reference to FIG. 3, the second end 73 of the main body has a flaired or increased diametral portion 82. Further, a circumscribing recess or channel 83 is formed in a predetermined location in the main body and is operable to receive a snap ring 84 therein. As illustrated most clearly by reference to FIG. 2, a second spring 90 is received about the main body 71 of the screw support assembly. The second spring has a first end 91, which rests on the snap ring 84, and a distal or second end 92. As seen most clearly by reference to FIG. 3, a plurality of apertures 93 are formed in the second end 73 of the main body 71. As seen most clearly by reference to FIG. 5, each of the apertures or bores 93 have a first, reduced diametral portion 94, and a second diametral portion 95 which is greater than the first portion. As best seen by reference to FIG. 4, the main body 71 also has an interior facing surface 100, which defines a channel or passageway 101. The channel or passageway has a predetermined diametral dimension greater than the outside diametral dimension of the bit 21. The channel further has a first end 102, and an opposite or second 103, which defines a screw receiving station 104 which is operable to receive the head 34 of the screw 30. As seen in FIG. 4, each of the apertures 93 communicate with the screw receiving station 104 and are generally oriented in radially extending relation thereto.

Figure 5:
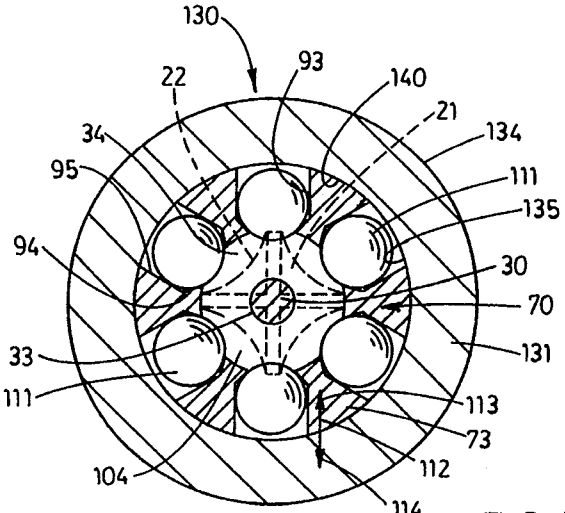
FIG. 5 is a somewhat enlarged, transverse, vertical sectional view of the apparatus of the subject invention, and which is taken from a position along line 5—5 of FIG. 2.

As best seen by reference to FIGS. 3, 4 and 5, the apparatus 10 of the subject invention includes a locking assembly which is generally indicated by the numeral 110. In the present invention, the locking assembly includes a plurality of spherical shaped members which correspond in number to the number of apertures 93 which are formed in the screw support assembly 70. As should be understood, the spherical members have diametral dimensions which are less than diametral dimensions of the second portion 95, but greater than first portion 94 of the individual apertures 93 which are formed in the screw support assembly 70. The plurality of spherical shaped members are movable along a path of travel 112 from a first, partially occluding position 113, where a portion of the individual spherical members extend in partially occluding relation relative to the screw receiving station 104, thereby engaging the head 34 of the screw 30. In this fashion, the screw is retained in the screw receiving station against the pressure of the bit 21, and more specifically, the first end 22 thereof.

Further, the individual spherical members are movable to a second, substantially nonoccluding position 114. As best seen by reference to FIG. 4, and when disposed in the second position, the individual spherical members are located in nonoccluding relation relative to the screw receiving station. When located in this position, the screw is released from the screw receiving station 104 and may be driven completely into the work piece or object 31.

As best seen by reference to FIGS. 3 and 4, a substantially circumscribing collar 120 provides a means for limiting motion of the screw support assembly 70 along the path of travel 75. More particularly, the circumscribing collar 120 has a main body 121 which defines a bore 122 which has a predetermined diametral dimension which is greater than the outside diametral dimension of the main body 71. Further, and as best seen by reference to FIG. 2, a threaded aperture 123 is formed in the main body 121 and is operable to receive a threaded fastener 124 therein. The fastener is operable to releasably fix the circumscribing collar in predetermined locations along the main body 71 of the screw support assembly 70. The operation of the circumscribing collar will be discussed in greater detail hereinafter.

As best seen by references to FIGS. 2, 3 and 4, an actuating assembly is generally indicated by the numeral 130. The actuating assembly includes a main body or sleeve 131 which has a first end 132, and an opposite second end 133. Further, the main body 131 has an external facing surface 134, and an internal facing surface 135 which defines a pair of substantially coaxial aligned bores 140. The pair of bores 140 include a first bore 141 which has a predetermined cross sectional or diametral dimension, and which is operable to telescopingly receive the main body 71 of the screw support assembly 70. As best seen by reference to FIG. 4, the diametral dimension of the first bore is just slightly greater than the outside diametral dimension of the main body of the screw support assembly. Further, the internal facing surface 135 of the second end 133 of the actuating assembly 130 defines a second bore 142 which has a cross sectional or diametral dimension which is greater than the cross sectional or diametral dimension of the first bore. As best seen by a comparison of FIGS. 2, 3 and 4, the actuating assembly is movable along a path of travel 143 between a first position, 144, and wherein the actuating assembly urges the individual spherical members 111 into the first, partially occluding position relative to the screw receiving station 104 which is shown in FIG. 5, and wherein when disposed in a second position 145 permits the individual spherical members 111 to move along their respective paths of travel 112 into the second, nonoccluding position which is best seen by reference to FIG. 4. As should be understood the second spring 90 is operable to bias or otherwise urge the actuating assembly 130 towards the first position. As should be recognized, as the apparatus 10 engages a work piece or surface 31, the actuating assembly 130 is urged rearwardly along the path of travel 143 from the first position to the second position 145. When the actuating assembly reaches the second position 145, as shown in FIG. 4, the individual spherical members 111 are operable to move along their respective paths of travel 112 from the first, partially occluding position, to the second, substantially nonoccluding position. When this event occurs, the screw 30 is released from the screw receiving station 104, and can be driven into the work piece. Further, and as physical pressure continues to be applied, the screw support assembly 70 is driven along the path of the travel 75 from the first, or extended position 80, towards the second, or retracted position 81, against the opposing force of the first spring 60. As the main body 71 is telescopingly received in the cavity 50, it is guided along the path of travel 75 by the individual pair of pins 56 which are acting in combination with the pair of coaxial aligned passageways or channels 54. Movement along the path of travel 75 continues until the collar 120 engages the main body 71, and more specifically, the second end 73 thereof. This is best seen by a study of FIG. 4. As will be recognized, when the collar engages the main body, further movement along the path of travel 74 is prohibited. As will be recognized, the collar provides a convenient means whereby the screw 30 may be driven to a predetermined distance into the work surface thereby countersinking it as shown in FIG. 4.

SECOND FORM

Figure 7:
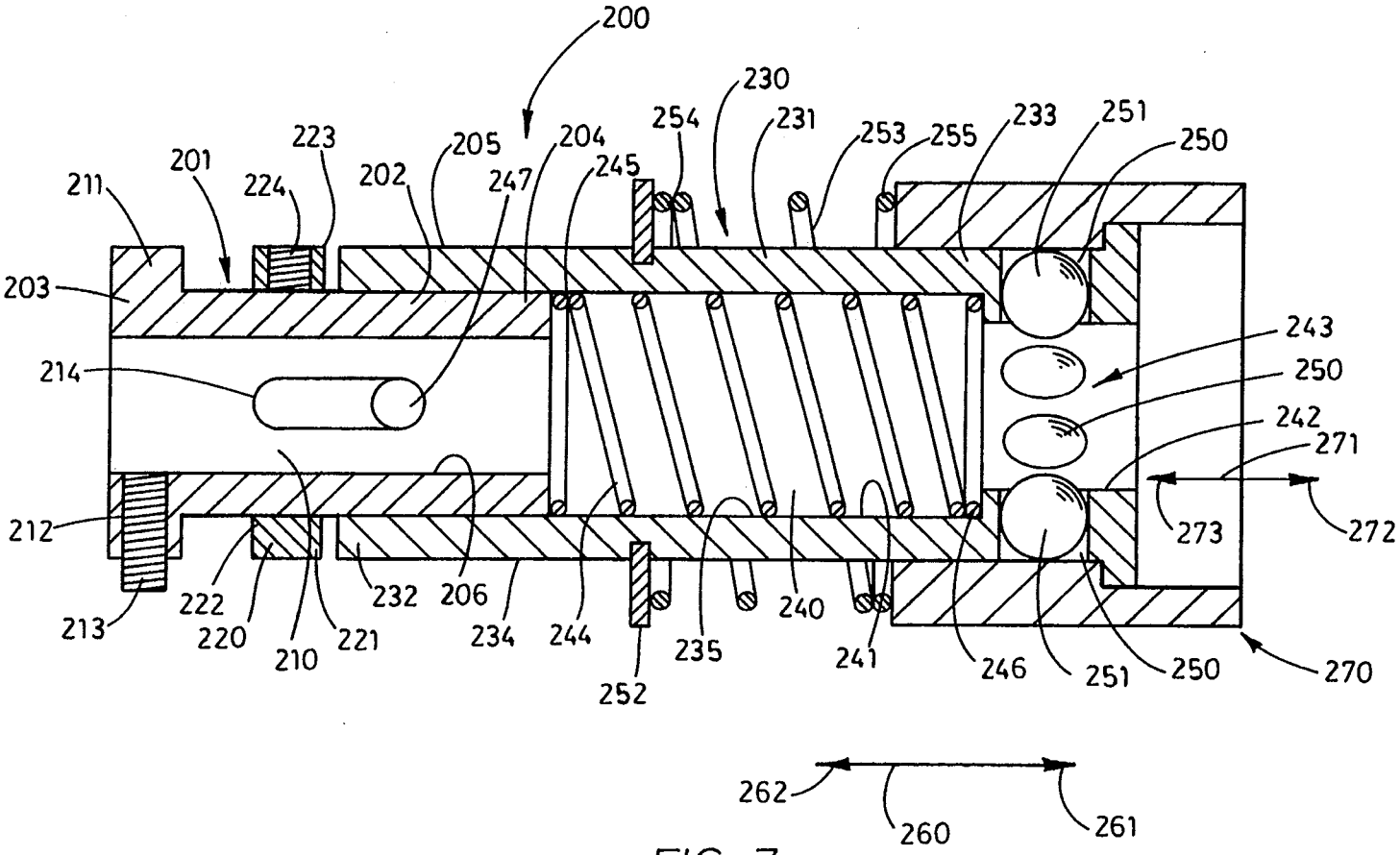
FIG. 7 is a somewhat enlarged, fragmentary, longitudinal side elevation view of a second form of the present invention with some underlying surfaces shown in phantom lines.

The second form of the present invention is generally indicated by the numeral 200 in FIG. 7. The apparatus 200 includes a housing 201, which has a substantially cylindrical shaped main body 202, and which further has a first end 203, and an opposite second end 204. Additionally, the main body is defined by an external facing surface 205; and an opposite internal facing surface 206 which defines a substantially continuous channel or passageway 210 which extends from the first to the second end. The channel or passageway has a diametral dimension which is greater than the outside diametral dimension of the rotatable bit 21. As best seen in FIG. 7, a circumscribing flange 211 is mounted on the first end 203 and further has a threaded passageway 212 formed therein. The passageway 212 is oriented in substantially radially extending relation relative to the channel or passageway 210 and is operable to receive a threaded fastener, such as an Allen screw 213, or the like. It should be understood that the Allen screw is threadably advanced into engagement with the drill bit thereby securing the housing in a fixed position on the drill bit. Further, formed in the exterior surface of the main body 202 is a pair of substantially coaxially aligned, and longitudinally extending channels 214.

Received about the main body 202 is a collar 220 which is similar to the collar 120 which was described earlier with respect to the first form 10 of the invention. The collar 220 has a main body 221 which defines an aperture 222. Further, a threaded channel 223 is formed in the main body and is operable to receive a screw 224 therein. The collar 220 operates in a fashion similar to that of the first form of the invention and therefore further discussion of this assembly is not warranted.

The second form of the apparatus 200 includes a screw support assembly which is generally indicated by the numeral 230. The screw support assembly includes a main body 231, which has a first end 232, and an opposite second end 233. Further, the main body has an exterior facing surface 234, and an opposite interior facing surface 235, which defines a channel or passageway which is generally indicated by the numeral 240. As best seen in FIG. 7, the channel or passageway includes a first bore 241, which has a predetermined diametral dimension which is just slightly greater than the outside diametral dimension of the housing 201; and a second bore 242, which is substantially coaxially aligned therewith, and which has a decreased diametral dimension in relative comparison to the first bore. As shown in the drawings, the second bore 242 defines a screw receiving station 243 which is operable to receive the head of the screw. The first bore 241 is operable to receive a first biasing assembly which is illustrated herein as a spring 244. The spring has a first end 245, which engages the housing, and an opposite second end 246 which engages the screw support assembly. As should be understood, a pair of posts 247 are mounted on the main body 231 of the screw support assembly and extend substantially radially inwardly relative thereto. The individual posts are operable to be received in each of the coaxially aligned channels 214 which are formed in the main body 202 of the housing 201. As earlier discussed with respect to the first form of the invention, the posts, and channels cooperate in a fashion to render the screw support assembly reciprocally and coaxially moveable relative to the housing.

As best seen in FIG. 7, a plurality of apertures 250 are formed in the second end 233 of the screw support assembly 230. The apertures, are identical to the apertures 93 which were discussed in significant detail with respect to the first form 10 of the invention. Therefore further discussion is not warranted. Additionally, the locking assembly of the present apparatus 200 is substantially identical to the first form 10, that is, it includes a plurality of spherical members 251 which are individually received in each of the apertures 250. A snap ring 252 is operable to engage the main body 231 of the screw support assembly 230, and a second biasing assembly, which takes the form of a second spring 253, is received about the main body of the screw support assembly. The spring has a first end 254, which rests on the snap ring 252, and an opposite second end 255. It should be understood that the screw support assembly is moveable along a path of travel 260 from a first or extended position 261, to a second or retracted position 262.

The second form of the invention 200 further has an actuating assembly 270 which is substantially identical to the first form 10 of the invention. Further, the actuating assembly is operable for movement along a path of travel 271, from a first position 272, to a second position 273. The apparatus 200 otherwise operates in a fashion identical to that of the first form of the invention 10 wherein, upon contact with the work piece, the actuating assembly 270 is moveable along the path of travel 271, from the first position 272, wherein the actuating assembly maintains or otherwise urges the individual spherical members into a partially occluding position relative to the screw receiving station, to the second position 273. Upon reaching the second position 273, the spherical members 251 are operable to move along the their respective paths of travel, as described earlier with respect to the first form 10 of the invention, out of partially occluding relation relative to the screw receiving station 243, thereby releasing the screw 30 and allowing it to be countersunk into the work object.

As earlier discussed with respect to the first form 10 of the invention, continued pressure applied to the apparatus 200 after contacting the work surface 31 causes the screw support assembly 230 to move along the path of travel 260, from the first, extended position 261, to the second, or retracted position 262 thereby allowing the drill bit to countersink the screw a predetermined distance into the work surface as determined by the position of the collar 220, which operates to limit movement of the screw support assembly along the path of travel 260.

Upon releasing the apparatus 200 from the work piece or object 31, the first biasing assembly, which is shown as a spring 244, is operable to urge the screw support assembly 230 along the path of travel 260 from the second or retracted position 262 to the first or extended position 261. Further, the second biasing assembly 253 is operable to urge the actuating assembly 270 along the path of travel 271, from the second position 273, to the first position 272 thereby urging the individual members back into partially occluding relation relative to the screw receiving station 243.

OPERATION

The operation of the described embodiments of the present invention are believed to be ready apparent and are briefly summarized at this point.

FIRST FORM

The apparatus 10 of the subject invention is best understood by a study of FIGS. 2, 3 and 4, respectively. As shown therein, the apparatus 10 of the subject invention, and which is useful for facilitating the installation of individual screws 30 into a work piece or surface 31, includes a rotatable bit 21 which is operable to engage the head 34 of a screw 30; and a housing 40 which is borne by the rotatable bit and which defines a cavity, and a passageway consisting of two substantially coaxially aligned bores 51 and 52. The bit is received in the passageway, and the housing rotates simultaneously with the bit. The apparatus 10 further includes a screw support assembly 70, which is borne by the housing, and which is telescopingly received in the cavity. The screw support assembly includes a passageway or channel 101 which defines a screw receiving station 104, and which is operable to receive the head of the screw 34. The apparatus 10 additionally includes a locking assembly 110, which is borne by the screw support assembly, and which is operable for travel from the first, partially occluding position 113, relative to the passageway 101, to a second, substantially nonoccluding position 114. Additionally, the apparatus 10 includes an actuating assembly 130 which is movably borne by the screw support assembly 70, and which positions the locking assembly 110 in the first, or second positions 113 or 114, respectively. As should be understood, the actuating assembly is freely rotatable relative to the screw support assembly. As will be recognized, when the locking assembly is disposed in the first, partially occluding position 113, the apparatus 10 is operable to retain the head of the screw in the screw receiving station 104, and when disposed in the second, substantially nonoccluding position 114, releases the screw from the screw receiving station 104 such that the screw may be driven into the work surface 31.

The apparatus 10 of the subject invention further includes a collar 120 which operates to limit movement of the screw support assembly 70 along its respective path of travel 75. The collar 120 provides a convenient means whereby the screw 30 may be countersunk into the work object 31 to a predetermined depth. This is best understood by a study of FIG. 4.

SECOND FORM

The operation of the second form of the invention 200 is quite similar, in some respects, to the first form of the invention 10. More particularly, the fastener support apparatus of the second form of the invention 200 includes a rotatable bit 21 for engaging the head 34 of a screw 30, and a housing 201 is borne by the rotatable bit and further defines a passageway 210. The bit is received in the passageway 210, and the housing simultaneously rotates with the bit. A screw support assembly 230 is movably borne by the housing and includes a passageway 240 that defines a screw receiving station 243, and which is operable to receive the head of the screw. A locking assembly 251 is movably borne by the screw support assembly, and operable for travel from a first, partially occluding position relative to the screw receiving station 243, to a second substantially nonoccluding position. An actuating assembly 270 is movably borne by the screw support assembly and positions the locking assembly in the first, or second positions. Salient differences between the first and second forms of the inventions relate to the relative positions, or orientations of the respective housings 12 and 201, respectively, and the screw support assemblies 70 and 230, respectively. As shown in FIG. 2, the screw support assembly 70 of the first form of the invention is telescopingly received internally of the housing 12. However, in the second form of the invention 200 the reverse is true, that is, the housing 201 is telescopingly received internally of the screw support assembly 230. Further, and in the first form of the invention 10, the first biasing assembly 60 is received in the cavity 50 which is defined by the housing 60. However, in the second form of the invention, the first biasing assembly 244 is received in the cavity or bore 241 which is defined by the screw support assembly 230.

The second form of the invention 200 finds particular utility when employed in combination with standard screw guns which are normally used for securing paneling and drywall.

Therefore, the apparatus 10 of the subject invention can be utilized for operation on a wide variety of screw driving means without further modifications thereto. In addition, the present invention may be used in all manner of commercial environments to expedite the assembly of various objects of commerce as well as can be utilized for various home improvement projects and the like. The apparatus can be easily installed, is simple to maintain and further, can be manufactured at a nominal price when compared with other prior art devices which are utilized for substantially identical purposes.

While the invention has been herein shown and described in what is conceived to be the most practical and preferred embodiment, it is to be recognized that departures may be made therefrom within the scope of the invention which is not to be limited to the illustrative details disclosed.

Having described and illustrated my new invention, what I claim as new and desire to secure by Letters Patent is:

1. A fastener support apparatus for facilitating the installation of individual screws into a work surface comprising:

a rotatable bit for engaging the head of the screw;

a housing borne by the rotatable bit and defining a passageway, and wherein the bit is received in the passageway, and the housing simultaneously rotates with the bit;

a screw support assembly movably borne by the housing and including a passageway defining a screw receiving station and which is operable to receive the head of the screw;

a locking assembly borne by the screw support assembly and operable for travel from a first, partially occluding position relative to the passageway, to a second, substantially nonoccluding position; and an actuating assembly borne by the screw support assembly, and which positions the locking assembly in the first or second positions, and wherein the actuating assembly is freely rotatable relative to the screw support assembly, and wherein during operation, the locking assembly, when disposed in the first, partially occluding position retains the head of the screw in the screw receiving station, and when disposed in the second, substantially nonoccluding position releases the screw from the screw receiving station such that the screw may be driven completely into the work surface.

2. A fastener support apparatus as claimed in claim 1, and wherein the rotatable bit has a main body and a screw engagement end, and wherein the housing is releasably secured in a predetermined location relative to the main body, and wherein the housing further includes a means for movably securing the screw support assembly for reciprocal slidable motion relative to the housing.

3. A fastener support apparatus as claimed in claim 1, and wherein the rotatable bit has a main body and a screw engagement end, and wherein the housing is releasably secured in a predetermined location relative to the main body, and wherein the screw support assembly includes means for movably securing the screw support assembly for reciprocal slidable motion relative to the housing.

4. A fastener support apparatus as claimed in claim 2, and wherein the bit is received in the passageway, and wherein a channel is formed in the screw support assembly, and wherein the means for securing the screw support assembly includes a post which is borne by the housing and received in the channel, and wherein the post and channel, acting in combination, defines a path of travel for the screw support assembly from a first, extended position, to a second, retracted position.

5. A fastener support apparatus as claimed in claim 3, and wherein a channel is formed in the housing, and wherein the means for securing the screw support assembly includes a post which is borne by the screw support assembly and received in the channel, and wherein the post and channel, acting in combination, defines a path of travel for the screw support assembly from a first, extended portion, to a second, retracted position.

6. A fastener support apparatus as claimed in claim 4, and wherein a first biasing assembly is received in a cavity of the housing and is operable to bias the screw support assembly toward the first, extended position, and wherein a means is borne by the screw support assembly for limiting movement along the path of travel.

7. A fastener support apparatus claimed in claim 5, and wherein a cavity is defined by the screw support assembly, and a first biasing assembly is received in the cavity and is operable to bias the screw support assembly toward the first, extended position, and wherein a means is borne by the housing for limiting movement of the screw support assembly along the path of travel.

8. A fastener support apparatus as claimed in claim 1, and wherein an aperture is formed in the screw support assembly and communicates with the screw receiving station, and wherein the locking assembly is received in the aperture, and is movable between the first, partially occluding position, and the second, substantially nonoccluding position.

9. A fastener support apparatus as claimed in claim 8, and wherein the actuating assembly includes a main body with opposite first and second ends, and internal and external facing surfaces, and wherein the internal facing surface of the first end defines a first bore having a predetermined cross sectional dimension, the first end telescopingly receiving the main body of the screw support assembly, and wherein the internal facing surface of the second end defines a second bore having a cross sectional dimension greater than the cross sectional dimension of the first bore, and wherein the main body is reciprocally moveable from a first position, wherein the main body urges the locking assembly into the first, partially occluding position, and wherein the main body when disposed in the second position permits the locking assembly to move to the second substantially nonoccluding position.

10. A fastener support apparatus as claimed in claim 9, and wherein a biasing assembly is borne by the screw support assembly and is operable to urge the main body of the actuating assembly into the first position, and wherein engagement of the actuating assembly with the work surface compresses the biasing assembly and urges the actuating assembly to the second position, and wherein continued force applied to the actuating assembly after reaching the second position urges a main body of the screw support assembly from a first, extended position, towards a second retracted position.

11. A fastener support apparatus as claimed in claim 10, and wherein a plurality of apertures are formed in the screw support assembly.

12. A fastener support apparatus as claimed in claim 11, and wherein the locking assembly includes a plurality of substantially spherical members corresponding in number with the apertures, and wherein the spherical members are individually movably mounted in each of the respective apertures.

13. A fastener support apparatus as claimed in claim 12, and wherein the means for limiting movement along the path of travel includes a releasably securable member which is borne by the main body of the screw support assembly and which engages the housing.

14. A fastener support apparatus for facilitating the installation of individual screws into a work surface comprising:

means for driving the individual screws into the work surface;

a housing borne by the drive means and defining a cavity, and wherein the drive means is received in the cavity;

a screw support assembly borne by the housing and reciprocally moveable along a path of travel from a first, extended position, to a second, retracted position, and wherein the screw support assembly includes a passageway defining a screw receiving station which is operable to receive the head of the screw;

a first spring positioned in force transmitting relation between the screw support assembly and the housing and operable to urge the screw support assembly towards the first position;

a locking assembly borne by the screw support assembly and operable for travel from a first, partially occluding position relative to the screw receiving station, to a second, substantially nonoccluding position; and an actuating assembly borne by the screw support assembly and which positions the locking assembly in the first or second positions, and wherein, during operation, the locking assembly, when disposed in the first, partially occluding position retains the head of the screw in the screw receiving station, and when disposed in the second, substantially nonoccluding position releases the screw from the screw receiving station such that the screw may be driven completely into the work surface to a predetermined depth.

15. A fastener support apparatus as claimed in claim 14, and wherein the means for driving the individual screws into the work surface includes a rotatable bit which has a main body and a screw engagement end, and wherein the housing further includes a bore which is substantially coaxially aligned with the cavity, and which has a diametral dimension which is greater than the diametral dimension of the rotatable bit, and wherein the housing is fixed in a predetermined location relative to the main body.

16. A fastener support apparatus as claimed in claim 15, and wherein the screw support assembly and the housing are disposed in telescoping relation, one to the other, and wherein the main body of the screw support assembly is forcibly engaged by the first spring, and wherein the main body of the screw support assembly has at least one aperture formed therein and which communicates with the screw receiving station, and wherein a channel is formed in the main body of the screw support assembly, and wherein a member is mounted on the housing and positioned in the cavity, and wherein the member is received in the channel thereby rendering the screw support assembly reciprocally moveable along the path of travel from the first, extended position, to the second retracted position.

17. A fastener support apparatus as claimed in claim 16, and wherein the locking assembly is received in the aperture and is moveable between the first, partially occluding position, and the second, substantially nonoccluding position, and wherein the actuating assembly includes a main body with opposite first and second ends, and internal and external facing surfaces, and wherein the internal facing surface of the first end defines a first bore having a predetermined cross sectional dimension, the first end telescopingly receiving the second end of the screw support assembly, and wherein the internal facing surface of the second end defines a second bore having a cross sectional dimension greater than the cross sectional dimension of the first bore, and wherein the actuating assembly is reciprocally moveable from a first position, wherein the main body urges the locking assembly into the first, partially occluding position, to a second position wherein the locking assembly is moveable to the second, substantially nonoccluding position.

18. A fastener support apparatus as claimed in claim 17, and wherein a second biasing spring is borne by the screw support assembly and is operable to urge the actuating assembly into the first position, and wherein engagement of the actuating assembly with the work surface compresses the second biasing spring and urges the actuating assembly to the second position, and wherein continued force applied to the actuating assembly after reaching the second position urges the main body of the screw support assembly from the first, extended position, towards the second, retracted position, thereby compressing the first spring.

19. A fastener support apparatus as claimed in claim 18, and wherein a plurality of apertures are formed in a predetermined pattern in the second end of the screw support assembly, and wherein the locking assembly further includes a plurality of substantially spherical members corresponding in number with the apertures, and wherein the spherical members are individually movably mounted in each of the respective apertures.

20. A fastener support apparatus as claimed in claim 19, and wherein the apparatus includes a means for limiting movement of the screw support assembly along the path of travel and wherein the means includes a releasable collar which is fixed in a predetermined position on the main body of the screw support assembly, and wherein movement of the screw support assembly along the path of travel from the first, extended position, towards the second, retracted position urges the collar into engagement with the housing thereby causing the bit to drive the screw a predetermined distance below the surface of the work surface.

* * * * *